US008651840B2

(12) United States Patent
Gang

(10) Patent No.: US 8,651,840 B2
(45) Date of Patent: Feb. 18, 2014

(54) PLUNGER PUMP FOR FABRICATING SOFT CAPSULES

(75) Inventor: Guibin Gang, Dongguan (CN)

(73) Assignee: Dongguan China-Mold Electromechanical Equipment Co. Ltd., Dongguan (CN)

( * ) Notice: Subject to any disclaimer, the term of this patent is extended or adjusted under 35 U.S.C. 154(b) by 318 days.

(21) Appl. No.: 13/013,602

(22) Filed: Jan. 25, 2011

(65) Prior Publication Data

US 2011/0217196 A1 Sep. 8, 2011

(30) Foreign Application Priority Data

Mar. 3, 2010 (CN) ..... 2010 2 0121479 U

(51) Int. Cl.
*F04B 7/04* (2006.01)

(52) U.S. Cl.
USPC ..... 417/510

(58) Field of Classification Search
USPC ..... 417/471, 510, 518, 519, 521
See application file for complete search history.

(56) References Cited

U.S. PATENT DOCUMENTS

| | | | | |
|---|---|---|---|---|
| 3,302,578 | A * | 2/1967 | Anderson | 417/488 |
| 7,938,632 | B2 * | 5/2011 | Smith | 417/415 |
| 2009/0196775 | A1 * | 8/2009 | Navarro | 417/460 |
| 2009/0269230 | A1 * | 10/2009 | Alaze | 417/521 |
| 2010/0111721 | A1 * | 5/2010 | Servin et al. | 417/321 |

* cited by examiner

*Primary Examiner* — Charles Freay
*Assistant Examiner* — Charles W Nichols
(74) *Attorney, Agent, or Firm* — Hanley, Flight and Zimmerman, LLC

(57) ABSTRACT

An example plunger pump for fabricating soft capsules includes switch and plunger bodies that form an accommodation space, the switch body has liquid suction and injection holes both communicative with the accommodation space, the plunger body has a channel for accommodating a plunger rod, and a rotary switch closely press-fit to the switch body to form a hermetic surface. The plunger rod linearly reciprocates in the channel so that the accommodation space periodically reaches maximum and minimum values of capacity. The structure of a rotary switch switches between opening and closing states of the liquid suction and injection holes, whereby it is substantially free of leakage of medical solution and there is no mixing and dissolving with lubricating oil during normal operation of the plunger pump, to thereby enhance the precision in the loading amount and eliminate the problem of contamination of the medical solution by the lubricating oil.

6 Claims, 4 Drawing Sheets

PLUNGER PUMP FOR FABRICATING SOFT CAPSULES

FIELD OF THE INVENTION

The present invention relates to devices for suction and expulsion of dosing of medical solutions, and more particularly, to a plunger pump for fabricating soft capsules.

BACKGROUND OF THE RELATED ART

Soft capsules are differently sized and differently shaped capsules formed by pressing and encapsulating oily functional substances, functional substance solutions or functional substance powder within gelatin membranes in controlled quantities. Soft capsules are a traditional formulation that finds wide applications in such fields as medicines, cosmetics and colored ball fabrication. Soft capsule products put a very high demand on the precision of loading amount.

Currently commercially available rotary die soft capsule producing devices generally make use of plunger pumps to fill in the contents of the soft capsules. Filling by plunger pumps has the advantages of highly consistent pill shapes, few difference in loading amounts, and compactness in structures, etc. To complete filling in a soft capsule, it is required that the plunger pump be able to continuously perform the actions of liquid suction and liquid injection, and that there must be means for switching between the liquid suction passage and the liquid injection passage. When the switching means opens the liquid suction hole, the liquid suction passage is communicative, and the plunger movement completes the liquid suction action. When the switching means opens the liquid injection hole, the liquid injection passage is communicative, and the plunger movement completes the liquid injection action.

The main structure of the means, or in other words the plunger pump, of a current rotary die soft capsule producing device for achieving the aforementioned functional requirements is as follows: a switchover plate is used to switch between opening and closing of the liquid suction hole and the liquid injection hole; it is usual to provide the switchover plate with multiple rows of channels (the number of channel rows can be different with the differing type models and yields of the soft capsule producing devices); the switchover plate moves to enable the corresponding channel to be communicative with the liquid suction passage or the liquid injection passage; the switchover plate cooperates and is assembled together with guide track pieces and upper and lower plates at both sides thereof in fixed gaps. Moreover, the switchover plate normally operates only when it has been lubricated by lubricating oil. The structure has the following main defects.

1) Since the communicative passage of the medical solution is opened or closed incessantly by means of the linearly reciprocating movement of the switchover plate, it is inevitable for the somewhat pressurized medical solution to "run" out from lateral gaps of the switchover plate, thereby affecting the precision in the loading amount of the soft capsule.

2) Since the lubricating oil has certain pressure, it infiltrates in the medical solution via lateral gaps of the switchover plate, thereby affecting the components and quality of the medical solution of the soft capsule.

3) The switchover plate is always in a state of violent attrition during the process of fabricating the soft capsule, and such attrition enlarges the gaps of the switchover plate in circumferential direction, so that this necessitates periodic maintenance of the plunger pump to adjust the gaps to proper size.

4) Suspension liquid having fine particulates is unsuited to serve as mother liquid, as the fine particulates would aggravate wearing-out of the switchover plate, thereby affecting the performance and use life of the plunger pump.

SUMMARY OF THE UTILITY MODEL

The objective of the present utility model is to provide a plunger pump for fabricating soft capsules, wherein a rotary switch is used to independently switch between the opening and the closing states of a liquid suction hole and a liquid injection hole to which each plunger corresponds; the rotary switch is closely press-fit with the surface of the member cooperative therewith to form a sealed structure having no gap, having high resistance-to-wear and being flexible in action; it is substantially free of leakage during liquid suction, precision and stability of loading are guaranteed, mixing and dissolving of medical solution with lubricating liquid are eliminated, and working performance of suspension liquid is improved.

In order to achieve the above objective, there is provided, according to one aspect, a plunger pump for fabricating soft capsules, which plunger pump includes a switch body and a plunger body interconnected to each other, a rotary switch adapted to the switch body, and a plunger rod adapted to the plunger body.

The switch body and the plunger body are closely connected to form an accommodation space, the switch body has a liquid suction hole and a liquid injection hole both communicative with the accommodation space, the plunger body has a channel for accommodating the plunger rod, and the rotary switch is closely attached to the switch body to form a hermetic surface.

The rotary switch has a notch thereon, with rotation of the rotary switch, the rotary switch closes the liquid injection hole when the notch opens the liquid suction hole, or the rotary switch closes the liquid suction hole when the notch opens the liquid injection hole.

The plunger rod performs a linearly reciprocating movement in the channel of the plunger body so that the accommodation space periodically reaches a maximum value of capacity and a minimum value of capacity.

Preferably, in the aforementioned plunger pump, a surface of the rotary switch and a surface of the switch body cooperative with the rotary switch each have a wear-resistant diamond-like plated layer, or the rotary switch and the switch body are made themselves of such a wear-resistant material as ceramic.

Preferably, in the aforementioned plunger pump, the rotary switch is connected with a rotary shaft, the switch body has a channel thereon for accommodating the rotary shaft, and the rotary shaft rotates in the channel of the switch body and simultaneously brings the rotary switch into rotation.

The rotary shaft and the switch body are provided therebetween with a seal ring and a bearing that supports the rotary shaft.

The rotary shaft is connected at end thereof with a spring, a thrust bearing, an adjusting nut, and a shifting fork, which are arranged at a side of the switch body opposite the rotary switch and mounted coaxial with the rotary shaft.

The adjusting nut presses, via the thrust bearing, the spring onto the switch body.

Preferably, in the aforementioned plunger pump, the rotary shaft has thereon a plurality of grooves along a radial direction, the grooves are uniformly arranged on a circumferential and an axial direction of the rotary shaft, or the rotary shaft is a corrugated tube shaft or a flexible shaft.

Preferably, in the aforementioned plunger pump, the interconnected plunger body and switch body are divided into two symmetrically arranged groups.

The plunger rod and the rotary switch can each be plural, arranged symmetrically and parallel to one another at an equidistance.

The two groups of switch bodies are connected via a deflecting plate having a liquid suction passage communicative with the liquid suction hole and a liquid injection passage communicative with the liquid injection hole.

The switch body, the plunger body, the rotary switch, the plunger rod, the seal ring assembly, the seal gasket, the seal ring, the bearing, the spring, the thrust bearing, the adjusting nut, the shifting fork, and the deflecting plate together constitute a pump core assembly.

Preferably, the aforementioned plunger pump further comprises a sliding plate assembly that brings the plunger rod into linearly reciprocating movement, a sliding block assembly that brings the rotary switch into rotational movement, and an eccentric shaft assembly that brings the sliding plate assembly and the sliding block assembly into movement;

Rotation of the eccentric shaft assembly brings the sliding plate assembly and the sliding block assembly into movement by the following periodical movement relations:

The sliding block assembly brings the rotary switch to rotate for a fixed angle, whereby the rotary switch closes the liquid injection hole and opens the liquid suction hole;

The sliding plate assembly brings the plunger rod into linear movement, whereby the accommodation space reaches the maximum value of capacity from the minimum value of capacity.

The sliding block assembly brings the rotary switch to rotate in reverse for a fixed angle, whereby the rotary switch closes the liquid suction hole and opens the liquid injection hole.

The sliding plate assembly brings the plunger rod into reversed linear movement, whereby the accommodation space reaches the minimum value of capacity from the maximum value of capacity.

The present utility model has at least the following technical effects.

1) The structure of a rotary switch, which is sealed with zero gap, is used to switch between the opening and the closing states of the liquid suction hole and the liquid injection hole, whereby it is substantially free of leakage of medical solution during normal operation of the plunger pump, to thereby enhance the precision in the loading amount.

2) The rotary switch and the member cooperative therewith are surface-coated with a hard and highly wear-resistant plated layer of ceramic, so that there are characteristics of auto-lubrication and flexible action without lubrication by lubricating oil, to thereby radically eliminate the problem of mixing and dissolving of the lubricating oil with the medical solution.

3) Wear-resistance of the rotary switch is greatly enhanced, use life is elongated, and maintenance and replacement are made easy.

4) There is no gap in the hermetic surface of the rotary switch, so that fine particulates of suspension liquid cannot enter the hermetic surface, and that attrition is not aggravated, thereby suitable for suction and injection of suspension medical solutions.

5) The peculiar structure of grooves of the rotary shaft enables the rotary shaft to produce ideal flexibility, so that the rotary switch is more closely fit to the cooperative surface, and the sealing is made more reliable.

6) Use of an adjustable pre-tensioned spring structure enables the rotary switch to be press-fit to its cooperative surface with an ideal pressure, whereby sealing is made more reliable.

EXPLANATIONS OF THE ACCOMPANYING DRAWINGS

SPECIFIC EMBODIMENTS

To make more apparent the objectives, technical solutions and advantages of the embodiments of the present utility model, specific embodiments are described in detail below with reference to the accompanying drawings.

The present utility model provides a plunger pump for fabricating soft capsules, which plunger pump includes a switch body and a plunger body interconnected to each other, a rotary switch adapted to the switch body, and a plunger rod adapted to the plunger body. The switch body and the plunger body are connected to form an accommodation space, the switch body has a liquid suction hole and a liquid injection hole both communicative with the accommodation space, the plunger body has a channel for accommodating the plunger rod, and the rotary switch has a notch and is closely press-fit to the switch body to form a hermetic surface. It is possible to switch between the opening and the closing states of the liquid suction hole and the liquid injection hole. The plunger rod performs a linearly reciprocating movement in the channel so that the accommodation space periodically reaches a maximum value of capacity and a minimum value of capacity.

The present utility model employs the structure of a rotary switch, which is sealed with zero gap, to switch between the opening and the closing states of the liquid suction hole and the liquid injection hole, whereby it is substantially free of leakage of medical solution and there is no mixing and dissolving with lubricating oil during normal operation of the plunger pump, to thereby enhance the precision in the loading amount and eliminate the problem of contamination of the medical solution by the lubricating oil.

Figure 1:
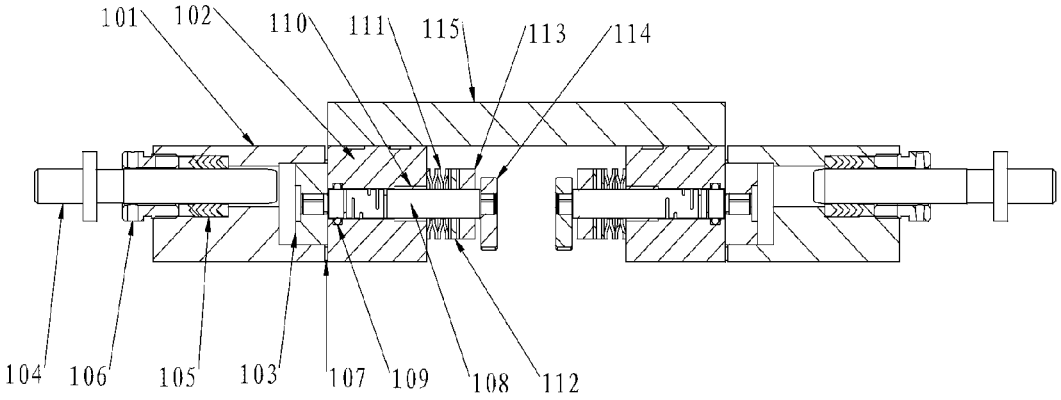
FIG. 1 is a structural view of the pump core assembly provided in the present utility model.
Figure 2:
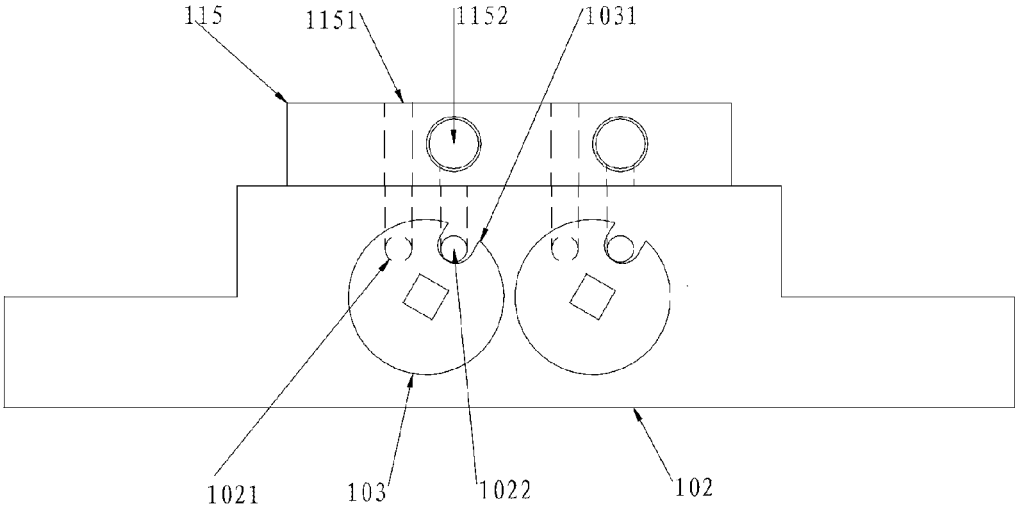
FIG. 2 is a view exemplarily illustrating the function of the rotary switch provided in the present utility model.
Figure 3:
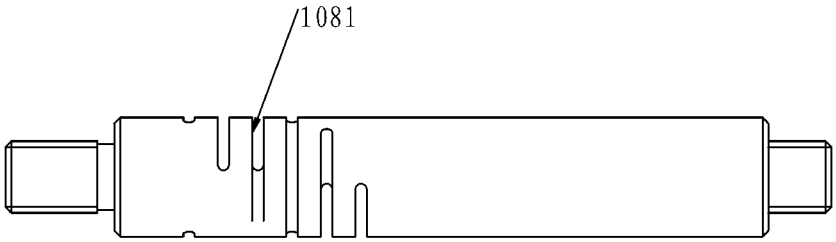
FIG. 3 is a main view illustrating the rotary shaft provided in the present utility model.

FIG. 1 is a structural view of the pump core assembly provided in the present utility model, FIG. 2 is a view exemplarily illustrating the function of the rotary switch provided in the present utility model, and FIG. 3 is a main view illustrating the rotary shaft provided in the present utility model.

As shown in FIGS. 1-3, the pump core assembly includes: a plunger body 101, a switch body 102, a rotary switch 103, a plunger rod 104, a seal ring assembly 105, a compression nut 106, a seal gasket 107, a rotary shaft 108, a seal ring 109, a bearing 110, a disc spring 111, a thrust bearing 112, an adjusting nut 113, a shifting fork 114, and a deflecting plate 115.

The switch body 102 has a medicine suction hole 1021 and a medicine injection hole 1022.

The rotary switch 103 has a notch 1031.

The rotary shaft 108 has grooves 1081.

The deflecting plate 115 has a medical solution inlet 1151 and a medical solution outlet 1152.

The rotary switch 103 is fixedly connected to the left end of the rotary shaft 108, and the adjusting nut 113 presses against the disc spring 111 via the thrust bearing 112. It is possible, by turning the adjusting nut 113, to adjust the pre-tensioning force of the disc spring 111 with respect to the switch body 102. This pre-tensioning force is equal to the pressing force of the rotary switch 103 with respect to the switch body 102.

Moreover, the rotary shaft 108 is provided with six grooves 1081 thereon, with adjacent grooves being displaced by 30 degrees with regard to each other on the radial direction of the rotary shaft. The six grooves 1081 are uniformly disposed on the circumference, and arranged at equidistance on the axial direction of the rotary shaft 108. Such a structure enables the rotary shaft to generate proper bending transformation under the action of external force.

The pre-tensioned structure of the disc spring 111 and the structure of grooves 1081 of the rotary shaft 108 structurally ensure the sealability of the rotary switch 103 with respect to the cooperative surface of the switch body 102.

The surface of the rotary switch 103 and the cooperative surface of the switch body 102 each have a diamond-like plated layer of high hardness and low friction coefficient, thus ensuring the sealability of the rotary switch 103 with respect to the cooperative surface of the switch body 102 in terms of material.

Figure 4:
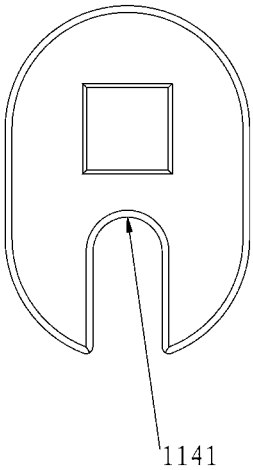
FIG. 4 is a main view illustrating the shifting fork provided in the present utility model.

FIG. 4 is a main view illustrating the shifting fork provided in the present utility model;

The shifting fork 114 has a notch 1141 to facilitate plucking by external force to bring the rotary switch 103 into rotation.

Figure 5:
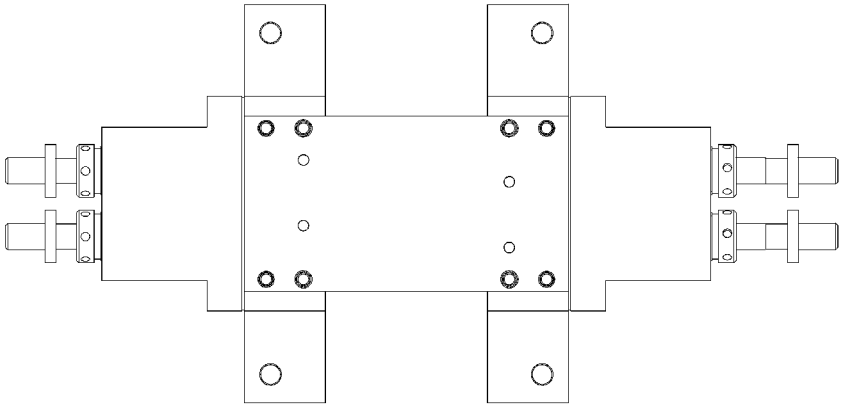
FIG. 5 is a top view illustrating the pump core assembly provided in the present utility model.

FIG. 5 is a top view illustrating the pump core assembly provided in the present utility model.

Two sets of switch bodies 102 and plunger bodies 101 are symmetrically arranged, and a plurality of plunger rods 104 can be uniformly arranged in parallel on the plunger body 101 at each side (the number of arranged rods may differ according to different model types of the soft capsule producing devices), with the plunger rods 104 at both sides of the transversal direction being correspondingly coaxially and symmetrically arranged.

Description of Operation: the rotary switch 103 makes reciprocating rotational (60 degrees) movement along the axial direction, while the plunger rod 104 makes horizontal and reciprocating linear movement.

Specifically, the shifting fork 114 receives external power to bring the rotary shaft 108 and the rotary switch 103 into rotation for a certain angle (60 degrees), and the notch 1031 on the rotary switch 103 enables the medicine injection hole 1022 (or medicine suction hole 1021) of the switch body 102 at one side and the medicine suction hole 1021 (or medicine injection hole 1022) of the switch body at another side to be communicative with the accommodation space, by which time the rotary switch 103 stops moving. Subsequently, the plunger rods 104 at both sides simultaneously perform linear movement along the same direction under the action of external power. The specific direction is as follows: at the side where the medicine injection hole 1022 of the switch body 102 is opened, the plunger rod 104 moves along a direction that reduces the capacity of the accommodation space, and the medical solution in the accommodation space is discharged via the medicine injection hole 1022 of the switch body 102 to the medical solution outlet 1152 of the deflecting plate 115; at the side where the medicine suction hole 1021 of the switch body 102 is opened, the plunger rod 104 moves precisely along a direction that increases the capacity of the accommodation space, and the medical solution is suctioned into the accommodation space from the medical solution inlet 1151 of the deflecting plate 115 via the medicine suction hole 1021 of the switch body 102; the plunger rods 104 stop after having moved to place, and the actions of medicine injection at one side and medicine suction at one side are completed.

Thereafter, the rotary switch 103 rotates in reverse for a certain angle (60 degrees), and the opening and closing states of the medicine injection holes 1022 and the medicine suction holes 1021 of the switch bodies 102 at both sides are interchanged, i.e., the side where the medicine injection hole 1022 of the switch body 102 was originally opened is now closed, while the medicine suction hole 1021 is opened; the side where the medicine suction hole 1021 of the switch body 102 was originally opened is now closed, while the medicine injection hole 1022 is opened. The plunger rods 104 at both sides move in reserve directions, the plunger rod 104 at one side that originally completed the medicine suction action now performs the medicine injection action, and the plunger rod 104 at one side that originally completed the medicine injection action now performs the medicine suction action. On completion of the medicine suction and injection actions, the plunger rods 104 and the rotary switch 103 precisely return to the initial positions, thus completing a whole round of action period.

The plunger rods 104 and the rotary switch 103 perform the periodical action in a sustained and alternate manner, so that the plunger pump continues to inject medicine and suction medicine.

FIG. 1 shows the state in which the plunger rod 104 at the left side completes the medicine injection action, and the plunger rod 104 at the right side completes the medicine suction action. Horizontal displacement of the plunger rod 104 decides the capacity of the medical solution suctioned or discharged by the plunger pump, namely the theoretical loading amount of the plunger pump.

Figure 6:
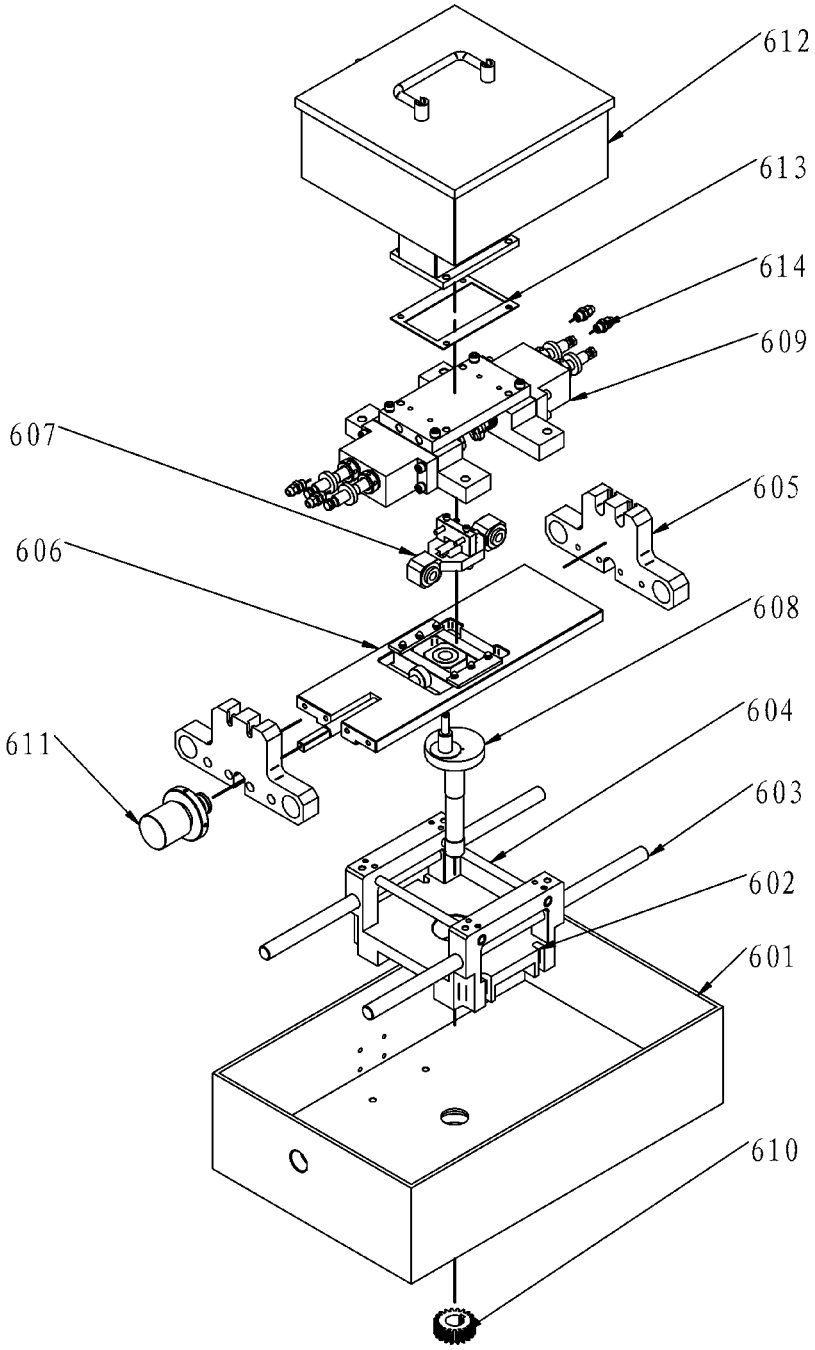
FIG. 6 is an explosive view illustrating the main component parts of the plunger pump provided in the present utility model.
Figure 7:
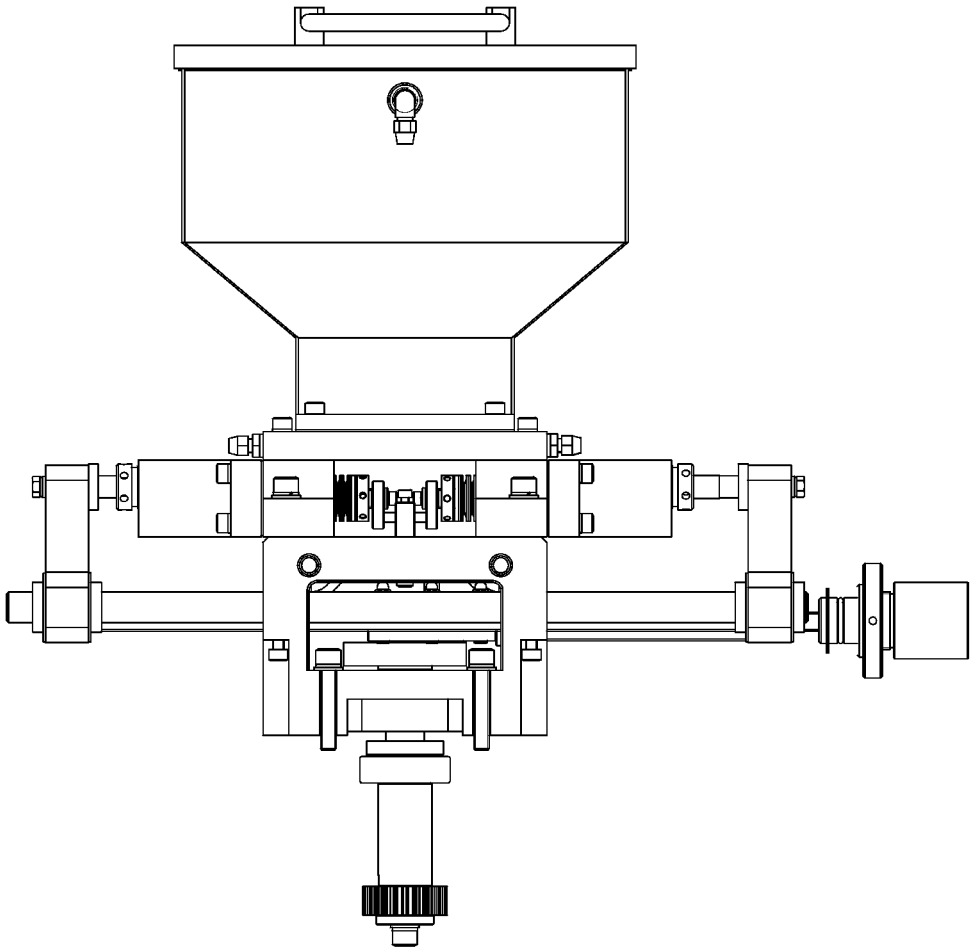
FIG. 7 is a main view illustrating the plunger pump provided in the present utility model with the pump housing removed.

FIG. 6 is an explosive view illustrating the main component parts of the plunger pump provided in the present utility model, and FIG. 7 is a main view illustrating the plunger pump provided in the present utility model with the pump housing removed. As shown in the Figs., main structural component parts of the plunger pump include the following:

Pump housing 601: structural housing of the plunger pump;

Pump base 602: mounting base of the plunger pump;

Greater guide rod 603: fixedly mounted on the pump base, a guide rail whereby a plunger rod supporting plate horizontally moves;

Lesser guide rod 604: fixedly mounted on the pump base, a guide rail whereby the sliding block assembly horizontally moves;

Plunger rod supporting plate 605: mounted on the greater guide rod, for fixedly mounting the plunger rod and bringing the plunger rod into horizontal movement;

Sliding plate assembly 606: both ends thereof respectively connected to the plunger rod supporting plate, and driving the plunger rod to make horizontal reciprocating movement; the switchover sliding plate assembly can be finely adjusted as to the stroke of its horizontal movement, whereby fine adjustment of the pump loading amount is achieved;

Sliding block assembly 607: mounted on the lesser guide rod and making reciprocating linear movement along the lesser guide rod, for plucking the shifting fork in the pump core, to enable the shifting fork to rotate for a certain angle;

Eccentric shaft assembly 608: mounted on the pump base and the pump housing, and bringing, via rotation of an eccentric shaft, the sliding plate assembly and the sliding block assembly into linear movement;

Pump core 609: kernel component part of the plunger pump, a direct functional body generating the actions of liquid suction and liquid injection;

Gear 610: connected with one end of the eccentric shaft assembly, inputting external power, and driving the plunger pump into normal operation;

Adjusting means 611: mounted on the pump housing, connected to the sliding plate assembly, and capable of adjusting the horizontal displacement amount of the sliding plate assembly in each action of medicine injection, to thereby achieve adjustment of the plunger pump loading amount;

Reservoir 612: a container for storing medical solution, and connected to the pump core, whereby the pump core suctions medical solution therefrom;

Reservoir seal gasket 613: mounted between the reservoir and the pump core, and functioning to seal the reservoir off; and Tube joint 614: mounted at the medical solution outlet of the deflecting plate, and capable of being connected to tubing for supply of medical solution.

Brief Explanation of the Operation Principles

The gear 610 rotates at a constant speed by means of external power to drive the eccentric shaft assembly 608 into rotation. The eccentric shaft assembly brings the sliding plate assembly 606 and the sliding block assembly 607 into linear movement, and the sliding plate assembly 606 and the sliding block assembly 607 do not simultaneously move, that is to say, the sliding block assembly 607 is stationary when the sliding plate assembly 606 moves, and the sliding plate assembly 606 is stationary when the sliding block assembly 607 moves. The moving directions of the sliding block assembly 607 and the sliding plate assembly 606 are perpendicular to each other. Firstly, the sliding block assembly 607 plucks the shifting fork 114 on the pump core 609 to enable the rotary switch 103 to generate angular displacement, and then the sliding plate assembly 606 brings the plunger rod 104 into horizontal movement. After the movement is in place, the sliding block assembly 607 again brings the rotary switch 103 into reversed angular displacement, and the opening and closing states of the liquid suction hole 1021 and the liquid injection hole 1022 of the switch body 102 are interchanged. The sliding plate assembly 606 starts to perform reversed movement, and a complete round of liquid suction and liquid injection is completed after the movement has been in place. Thereafter the plunger pump performs the periodical movement always by the same regularity, thus continuously performing suction and injection of dosing of liquid.

Rotation of the eccentric shaft assembly 608 brings the sliding plate assembly 606 and the sliding block assembly 607 into movement by the following periodical movement relations:

1) The sliding block assembly 607 brings the rotary switch 103 to rotate for 60 degrees, whereby the rotary switch 103 closes the liquid injection hole 1022 and opens the liquid suction hole 1021;

2) the sliding plate assembly 606 brings the plunger rod 104 into linear movement, whereby the accommodation space reaches the maximum value of capacity from the minimum value of capacity;

3) the sliding block assembly 607 brings the rotary switch 103 to rotate in reverse for 60 degrees, whereby the rotary switch 103 closes the liquid suction hole 1021 and opens the liquid injection hole 1022;

4) the sliding plate assembly 606 brings the plunger rod 104 into reversed linear movement, whereby the accommodation space reaches the minimum value of capacity from the maximum value of capacity.

The reciprocating rotational movement of the rotary switch 103 and the reciprocating linear movement of the plunger rod 104 never simultaneously occur; that is to say, when the rotary switch 103 acts, the plunger rod 104 is inactive; when the plunger rod 104 acts, the rotary switch 103 is inactive.

As can be known from the above, embodiments of the present utility model have the following advantages.

1) The structure of a rotary switch, which is sealed with zero gap, is used to switch between the opening and the closing states of the liquid suction hole and the liquid injection hole, whereby it is substantially free of leakage of medical solution during normal operation of the plunger pump, to thereby enhance the precision in the loading amount.

2) The rotary switch and the member cooperative therewith are surface-coated with a hard and highly wear-resistant plated layer of ceramic, so that there are characteristics of auto-lubrication and flexible action without lubrication by lubricating oil, to thereby radically eliminate the problem of mixing and dissolving of the lubricating oil with the medical solution.

3) Wear-resistance of the rotary switch is greatly enhanced, use life is elongated, and maintenance and replacement are made easy.

4) There is no gap in the hermetic surface of the rotary switch, so that fine particulates of suspension liquid cannot enter the hermetic surface, and that attrition is not aggravated, thereby suitable for suction and injection of suspension medical solutions.

5) The peculiar structure of grooves of the rotary shaft enables the rotary shaft to produce ideal flexibility, so that the rotary switch is more closely fit to the cooperative surface, and the sealing is made more reliable.

6) Use of an adjustable pre-tensioned spring structure enables the rotary switch to be press-fit to its cooperative surface with an ideal pressure, whereby sealing is made more reliable.

The above are merely preferred embodiments of the present utility model. As should be pointed out, persons ordinarily skilled in the art may make various improvements and modifications without departing from the principles of the present utility model. All these improvements and modifications shall also be regarded as within the protection scope of the present utility model.

The invention claimed is:

1. A plunger pump for fabricating soft capsules, comprising:

a switch body and a plunger body interconnected to each other;

a rotary switch associated with the switch body; and a plunger rod associated with the plunger body, the switch body and the plunger body define an accommodation space, the switch body has a liquid suction hole and a liquid injection hole, both the liquid suction hole and the liquid injection hole are in communication with the accommodation space, the plunger body has a channel to accommodate the plunger rod, and the rotary switch is attached to the switch body to form a hermetic surface;

the rotary switch has a notch thereon, by rotation of the rotary switch, the rotary switch closes the liquid injection hole when the notch opens the liquid suction hole, or the rotary switch closes the liquid suction hole when the notch opens the liquid injection hole;

the plunger rod to perform a linearly reciprocating movement in the channel of the plunger body so that the accommodation space periodically reaches a maximum value of capacity and a minimum value of capacity, wherein the rotary switch is connected with a rotary shaft, the switch body has a channel thereon to accommodate the rotary shaft, and the rotary shaft is positioned to rotate in the channel of the switch body to simultaneously bring the rotary switch into rotation;

the rotary shaft and the switch body are provided therebetween with a seal ring and a bearing that supports the rotary shaft;

the rotary shaft is connected at an end thereof with a spring, a thrust bearing, an adjusting nut, and a shifting fork, which are arranged at a side of the switch body opposite the rotary switch and mounted coaxial with the rotary shaft;

the adjusting nut is positioned to press, via the thrust bearing, the spring onto the switch body.

2. The plunger pump according to claim 1, wherein each of a surface of the rotary switch and a surface of the switch body cooperative with the rotary switch has a wear-resistant plated layer, or the rotary switch and the switch body comprise a wear-resistant material.

3. The plunger pump according to claim 1, wherein the rotary shaft has thereon a plurality of grooves along a radial direction, the grooves are uniformly arranged on a circumference and an axial direction of the rotary shaft, or the rotary shaft is a corrugated tube shaft or a flexible shaft.

4. The plunger pump according to claim 3, wherein the interconnected plunger body and switch body are symmetrically arranged in two groups;

the plunger rod and the rotary switch can each be plural, arranged symmetrically and parallel to one another at an equidistance;

the two groups of switch bodies are connected via a deflecting plate having a liquid suction passage in communication with the liquid suction hole and a liquid injection passage in communication with the liquid injection hole;

the switch body, the plunger body, the rotary switch, the plunger rod, a seal ring assembly, a seal gasket, the seal ring, the bearing, the spring, the thrust bearing, the adjusting nut, the shifting fork, and the deflecting plate together constitute a pump core assembly.

5. The plunger pump according to claim 4, further comprising:

a sliding plate assembly to linearly reciprocate the plunger rod;

a sliding block assembly to rotate the rotary switch;

an eccentric shaft assembly to move the sliding plate assembly and the sliding block assembly;

wherein rotation of the eccentric shaft assembly moves the sliding plate assembly and the sliding block assembly by the following periodical movement:

the sliding block assembly rotates the rotary switch through a fixed angle, whereby the rotary switch closes the liquid injection hole and opens the liquid suction hole;

the sliding plate assembly linearly moves the plunger rod, whereby the accommodation space reaches the maximum value of capacity from the minimum value of capacity;

the sliding block assembly rotates the rotary switch in reverse for the fixed angle, whereby the rotary switch closes the liquid suction hole and opens the liquid injection hole; and the sliding plate assembly linearly moves the plunger rod in reverse, whereby the accommodation space reaches the minimum value of capacity from the maximum value of capacity.

6. The plunger pump according to claim 2, wherein the wear-resistant material is a ceramic.

* * * * *